US007080517B2

(12) United States Patent
Schlote

(10) Patent No.: US 7,080,517 B2
(45) Date of Patent: Jul. 25, 2006

(54) COMBUSTION METHOD AND APPARATUS

(75) Inventor: Andrew Schlote, Fenton, MO (US)

(73) Assignee: Innovative Energy, Inc., St. Charles, MO (US)

( * ) Notice: Subject to any disclaimer, the term of this patent is extended or adjusted under 35 U.S.C. 154(b) by 51 days.

(21) Appl. No.: 10/255,879

(22) Filed: Sep. 26, 2002

(65) Prior Publication Data

US 2004/0060300 A1 Apr. 1, 2004

(51) Int. Cl.
*F23C 5/32* (2006.01)
*F02C 1/00* (2006.01)

(52) U.S. Cl. ..... 60/776; 60/39.511; 60/750; 431/11; 431/173

(58) Field of Classification Search ..... 431/173, 431/6, 11; 60/39.511, 776, 804, 750
See application file for complete search history.

(56) References Cited

U.S. PATENT DOCUMENTS

| | | | | |
|---|---|---|---|---|
| 3,039,406 | A * | 6/1962 | Aref | 110/264 |
| 3,265,113 | A | 8/1966 | Thurley et al. | |
| 3,500,775 | A | 3/1970 | Hubbard | |
| 3,720,497 | A | 3/1973 | Arenson | |
| 3,736,094 | A | 5/1973 | Shisler | |
| 3,856,455 | A | 12/1974 | Otway et al. | |
| 4,113,425 | A | 9/1978 | Von Linde et al. | |
| 4,302,177 | A | 11/1981 | Fankhanel et al. | |
| 4,429,538 | A | 2/1984 | Sato et al. | |
| 5,014,631 | A | 5/1991 | Ikeda et al. | |
| 5,015,171 | A | 5/1991 | Zinn et al. | |
| 5,394,937 | A | 3/1995 | Nieh | |
| 5,462,430 | A | 10/1995 | Khinkis | |
| 6,161,768 | A * | 12/2000 | Gordon et al. | 237/12.1 |
| 6,210,149 | B1 | 4/2001 | Plavnik et al. | |
| 6,513,318 | B1 * | 2/2003 | Wright | 60/39.511 |
| 2002/0192608 | A1 * | 12/2002 | Flament et al. | 431/173 |
| 2003/0033808 | A1 | 2/2003 | Schlote | |

FOREIGN PATENT DOCUMENTS

| | | | | |
|---|---|---|---|---|
| DE | 2236372 | * | 9/1977 | 431/173 |
| WO | WO 00/60225 | | 10/2000 | |

OTHER PUBLICATIONS

PCT International Search Report, International Application No. PCT/US05/17834, Mailed Oct. 13, 2005.

* cited by examiner

*Primary Examiner*—Charles G. Freay
(74) *Attorney, Agent, or Firm*—Thompson Coburn LLP

(57) ABSTRACT

A method comprising providing a combustion apparatus, introducing a fuel into the combustion apparatus, and introducing feed air into the combustion apparatus. The method further comprises using the combustion apparatus to cause at least some of the fuel and at least some of the feed air to swirl within the combustion region and about a longitudinal axis of the combustion apparatus, and causing an initial combustion reaction of some of the swirling fuel and feed air in the combustion region to form combustion reaction products. Some of the swirling fuel at least temporarily remains unburned. The swirling is sufficient to cause the unburned fuel to move radially away from the longitudinal axis and to cause the combustion reaction products to move radially toward the longitudinal axis.

34 Claims, 4 Drawing Sheets

COMBUSTION METHOD AND APPARATUS

SUMMARY OF THE INVENTION

One aspect of the present invention is a method comprising providing a combustion apparatus. The combustion apparatus comprises an outer vessel and an inner conduit. The outer vessel has a first longitudinally extending wall extending generally along a central axis. The outer vessel further has a forward end and a rearward end. The rearward end is longitudinally spaced from the forward end. The inner conduit is at least partially within the outer vessel and has a forward intake port, a rearward discharge port, and a second longitudinally extending wall extending generally along the central axis between the intake and discharge ports and generally coaxial with the first longitudinally extending wall. The second longitudinally extending wall has at least a forward longitudinal portion which is spaced radially inwardly of the first longitudinally extending wall. The intake and discharge ports and the second longitudinally extending wall define a central fluid passage through the inner conduit. The intake port is between the forward and rearward ends of the outer vessel and is spaced from both of the forward and rearward ends of the outer vessel. The outer vessel further comprises a forward combustion region and a rearward fluid passage. The forward combustion region is at least partially circumscribed by the first longitudinally extending wall and is longitudinally forward of the intake port of the inner conduit. The rearward fluid passage is longitudinally rearward of the intake port of the inner conduit. The rearward fluid passage is defined between the first and second longitudinally extending walls and is generally annular in shape. The method further comprises introducing feed air into the rearward fluid passage in a generally tangential direction relative to the rearward fluid passage in a manner such that at least some of the feed air swirls around the second longitudinally extending wall, introducing a fuel into the combustion region, facilitating mixing of the fuel and the feed air in the combustion region, causing a combustion reaction of the mixed fuel and feed air in the combustion region in a manner such that at least 70% of the fuel entering the combustion region is combusted in either the combustion region or the rearward fluid passage to form combustion reaction products, and discharging the combustion reaction products longitudinally rearward through the central fluid passage of the inner conduit.

Another aspect of the present invention is a method comprising providing a combustion apparatus. The combustion apparatus comprises an outer vessel and an inner conduit. The outer vessel has a first longitudinally extending wall extending generally along a central axis. The outer vessel further has a forward end and a rearward end. The rearward end is longitudinally spaced from the forward end. The inner conduit is at least partially within the outer vessel and having a forward intake port, a rearward discharge port, and a second longitudinally extending wall extending generally along the central axis between the intake and discharge ports and generally coaxial with the first longitudinally extending wall. The second longitudinally extending wall has at least a forward longitudinal portion which is spaced radially inwardly of the first longitudinally extending wall. The intake and discharge ports and the second longitudinally extending wall define a central fluid passage through the inner conduit. The intake port is between the forward and rearward ends of the outer vessel and is spaced from both of the forward and rearward ends of the outer vessel. The outer vessel further comprises a forward combustion region and a rearward fluid passage. The forward combustion region is at least partially circumscribed by the first longitudinally extending wall and is longitudinally forward of the intake port of the inner conduit. The rearward fluid passage is longitudinally rearward of the intake port of the inner conduit. The rearward fluid passage is defined between the first and second longitudinally extending walls and is generally annular in shape. The method further comprises introducing pressurized feed air having a pressure of at least 30 psia into the rearward fluid passage. The pressurized feed air is introduced into the rearward fluid passage in a generally tangential direction relative to the rearward fluid passage in a manner such that at least some of the feed air swirls around the second longitudinally extending wall. The method further comprises introducing a fuel into the combustion region, facilitating mixing of the fuel and the feed air in the combustion region, causing a combustion reaction of the mixed fuel and feed air in the combustion region in a manner such that at least some of the fuel entering the combustion region is combusted in the combustion region to form combustion reaction products, and discharging the combustion reaction products longitudinally rearward through the central fluid passage of the inner conduit.

Another aspect of the present invention is a method comprising providing a combustion apparatus, introducing into the combustion apparatus feed air having a pressure of at least 30 psia, introducing a fuel into the combustion apparatus, using the combustion apparatus to cause at least some of the fuel and at least some of the feed air to swirl within the combustion apparatus and about a longitudinal axis of the combustion apparatus, causing an initial combustion reaction of some of the swirling fuel and feed air in the combustion apparatus to form combustion reaction products. Some of the swirling fuel at least temporarily remains unburned. The swirling is sufficient to cause the unburned fuel to move radially away from the longitudinal axis and to cause the combustion reaction products to move radially toward the longitudinal axis.

Another aspect of the present invention is a method comprising providing a combustion apparatus, introducing a fuel into the combustion apparatus, heating feed air to a pre-heat temperature at least as great as an ignition temperature of the fuel, and introducing the feed air into the combustion apparatus. The feed air is heated to the pre-heat temperature before the feed air is introduced into the combustion apparatus. The method further comprises using the combustion apparatus to cause at least some of the fuel and at least some of the feed air to swirl within the combustion apparatus and about a longitudinal axis of the combustion apparatus, and causing an initial combustion reaction of some of the swirling fuel and feed air in the combustion apparatus to form combustion reaction products. Some of the swirling fuel at least temporarily remains unburned. The swirling is sufficient to cause the unburned fuel to move radially away from the longitudinal axis and to cause the combustion reaction products to move radially toward the longitudinal axis.

Another aspect of the present invention is a combustion apparatus for combusting a fuel. The combustion apparatus comprises an outer vessel, an inner conduit, a tangential feed air inlet, a fuel inlet, and an igniter. The outer vessel has a first longitudinally extending wall extending generally along a central axis. The first longitudinally extending wall having a generally circular shape when viewed in a cross-section taken in a plane perpendicular to the central axis. The outer vessel further has a forward end and a rearward end. The rearward end is longitudinally spaced from the forward end. The inner conduit is at least partially within the outer vessel and has a forward intake port, a rearward discharge port, and a second longitudinally extending wall extending generally along the central axis between the intake and discharge ports and generally coaxial with the first longitudinally extending wall. The second longitudinally extending wall having at least a forward longitudinal portion which is spaced radially inwardly of the first longitudinally extending wall. The intake and discharge ports and the second longitudinally extending wall define a central fluid passage through the inner conduit. The intake port is between the forward and rearward ends of the outer vessel and is spaced from both of the forward and rearward ends of the outer vessel. The outer vessel further comprises a forward combustion region and a rearward fluid passage. The forward combustion region is at least partially circumscribed by the first longitudinally extending wall and is longitudinally forward of the intake port of the inner conduit. The rearward fluid passage is longitudinally rearward of the intake port of the inner conduit. The rearward fluid passage is defined between the first and second longitudinally extending walls and is generally annular in shape. The tangential feed air inlet is through the outer vessel for introducing feed air into the rearward fluid passage. The feed air inlet is longitudinally spaced between the intake port of the inner conduit and the rearward end of the outer vessel. The feed air inlet is adapted and configured such that at least some of the feed air introduced through the feed air inlet and into the rearward fluid passage swirls around the second longitudinally extending wall. The fuel inlet is adapted for introducing fuel into the combustion region. The igniter is adapted for igniting the fuel in the combustion region. The combustion apparatus is adapted to cause the fuel and the feed air to mix in the combustion region. The combustion apparatus is further adapted to cause a combustion reaction of the mixed fuel and feed air in the combustion region in a manner to form combustion reaction products and to cause the combustion reaction products to pass rearwardly through the central fluid passage of the inner conduit. The combustion apparatus is further adapted such that at least 70% of the fuel entering the combustion region is combusted in the combustion region.

Another aspect of the present invention is a combustion apparatus for combusting a fuel. The combustion apparatus comprises an outer vessel, an inner conduit, a tangential feed air inlet, a flow divider, and a fuel inlet. The outer vessel has a first longitudinally extending wall extending generally along a central axis. The first longitudinally extending wall has a generally circular shape when viewed in a cross-section taken in a plane perpendicular to the central axis. The outer vessel further has a forward end and a rearward end. The rearward end is longitudinally spaced from the forward end. The inner conduit is at least partially within the outer vessel and has a forward intake port, a rearward discharge port, and a second longitudinally extending wall extending generally along the central axis between the intake and discharge ports and generally coaxial with the first longitudinally extending wall. The second longitudinally extending wall has at least a forward longitudinal portion which is spaced radially inwardly of the first longitudinally extending wall. The intake and discharge ports and the second longitudinally extending wall define a central fluid passage through the inner conduit. The intake port is between the forward and rearward ends of the outer vessel and is spaced from both of the forward and rearward ends of the outer vessel. The outer vessel further comprises a forward combustion region and a rearward fluid passage. The forward combustion region is at least partially circumscribed by the first longitudinally extending wall and is longitudinally forward of the intake port of the inner conduit. The rearward fluid passage is longitudinally rearward of the intake port of the inner conduit. The rearward fluid passage is defined between the first and second longitudinally extending walls and is generally annular in shape. The tangential feed air inlet is through the outer vessel for introducing feed air into the rearward fluid passage. The feed air inlet is longitudinally spaced between the intake port of the inner conduit and the rearward end of the outer vessel. The feed air inlet is adapted and configured such that at least some of the feed air introduced through the feed air inlet and into the rearward fluid passage swirls around the second longitudinally extending wall. The flow divider is within the forward combustion region. The flow divider is forward of and spaced from the forward intake port of the inner conduit and is rearward of and spaced from the forward end of the outer vessel. The fuel inlet is for introducing fuel into the combustion region. The combustion apparatus is adapted to cause the fuel and the feed air to mix in the combustion region. The combustion apparatus is further adapted to cause a combustion reaction of the mixed fuel and feed air in the combustion region in a manner to form combustion reaction products and to cause the combustion reaction products to pass rearwardly through the central fluid passage of the inner conduit. The flow divider is adapted to deflect some of the feed air in a manner such that said some of the feed air flows from the feed air inlet into the inner conduit without flowing into any portion of the combustion region which is forward of the flow divider.

Another aspect of the present invention is a system comprising a compressor and a combustion apparatus. The compressor is adapted to pressurize air to a pressure of at least 30 psia and has a discharge port for discharging pressurized feed air from the compressor. The combustion apparatus is adapted for combusting a fuel. The combustion apparatus comprises an outer vessel, an inner conduit, a tangential feed air inlet, a fuel inlet, and an igniter. The outer vessel has a first longitudinally extending wall extending generally along a central axis. The first longitudinally extending wall has a generally circular shape when viewed in a cross-section taken in a plane perpendicular to the central axis. The outer vessel further has a forward end and a rearward end. The rearward end is longitudinally spaced from the forward end. The inner conduit is at least partially within the outer vessel and has a forward intake port, a rearward discharge port, and a second longitudinally extending wall extending generally along the central axis between the intake and discharge ports and generally coaxial with the first longitudinally extending wall. The second longitudinally extending wall has at least a forward longitudinal portion which is spaced radially inwardly of the first longitudinally extending wall. The intake and discharge ports and the second longitudinally extending wall define a central fluid passage through the inner conduit. The intake port is between the forward and rearward ends of the outer vessel and is spaced from both of the forward and rearward ends of the outer vessel. The outer vessel further comprises a forward combustion region and a rearward fluid passage. The forward combustion region is at least partially circumscribed by the first longitudinally extending wall and is longitudinally forward of the intake port of the inner conduit. The rearward fluid passage is longitudinally rearward of the intake port of the inner conduit, is defined between the first and second longitudinally extending walls, and is generally annular in shape. The tangential feed air inlet is in fluid communication with the discharge port of the compressor and is adapted for introducing the pressurized feed air through the outer vessel and into the rearward fluid passage. The feed air inlet is longitudinally spaced between the intake port of the inner conduit and the rearward end of the outer vessel. The feed air inlet is adapted and configured such that at least some of the feed air introduced through the feed air inlet and into the rearward fluid passage swirls around the second longitudinally extending wall. The fuel inlet is adapted to introduce fuel into the combustion region. The igniter is positioned and adapted to ignite the fuel in the combustion region. The combustion apparatus is adapted to cause: the fuel and the feed air to mix in the combustion region; a combustion reaction of the mixed fuel and feed air in the combustion region in a manner to form combustion reaction products; and the combustion reaction products to pass rearwardly through the central fluid passage of the inner conduit.

Another aspect of the present invention is a system comprising a compressor, a combustion apparatus, and a radial out-flow turbine. The compressor is adapted to pressurize air and has a discharge port for discharging pressurized feed air from the compressor. The combustion apparatus is adapted for combusting a fuel and comprises an outer vessel, and inner conduit, a tangental feed air inlet, and a fuel inlet. The outer vessel has a first longitudinally extending wall extending generally along a central axis. The first longitudinally extending wall has a generally circular shape when viewed in a cross-section taken in a plane perpendicular to the central axis. The outer vessel further has a forward end and a rearward end. The rearward end is longitudinally spaced from the forward end. The inner conduit is at least partially within the outer vessel and has a forward intake port, a rearward discharge port, and a second longitudinally extending wall extending generally along the central axis between the intake and discharge ports and generally coaxial with the first longitudinally extending wall. The second longitudinally extending wall has at least a forward longitudinal portion which is spaced radially inwardly of the first longitudinally extending wall. The intake and discharge ports and the second longitudinally extending wall define a central fluid passage through the inner conduit. The intake port is between the forward and rearward ends of the outer vessel and is spaced from both of the forward and rearward ends of the outer vessel. The outer vessel further comprises a forward combustion region and a rearward fluid passage. The forward combustion region is at least partially circumscribed by the first longitudinally extending wall and is longitudinally forward of the intake port of the inner conduit. The rearward fluid passage is longitudinally rearward of the intake port of the inner conduit. The rearward fluid passage is defined between the first and second longitudinally extending walls and is generally annular in shape. The tangential feed air inlet is in fluid communication with the discharge port of the compressor and is adapted for introducing the pressurized feed air through the outer vessel and into the rearward fluid passage. The feed air inlet is longitudinally spaced between the intake port of the inner conduit and the rearward end of the outer vessel. The feed air inlet is adapted and configured such that at least some of the feed air introduced through the feed air inlet and into the rearward fluid passage swirls around the second longitudinally extending wall. The fuel inlet is adapted to introduce fuel into the combustion region. The combustion apparatus is adapted to cause the fuel and the feed air to mix in the combustion region. The combustion apparatus is further adapted to cause a combustion reaction of the mixed fuel and feed air in the combustion region in a manner to form combustion reaction products and to cause the combustion reaction products to pass rearwardly through the central fluid passage of the inner conduit. The radial out-flow turbine has a rotor. The turbine is in fluid communication with the central fluid passage of the inner conduit. The turbine and the combustion apparatus are configured and adapted such that the combustion reaction products which pass rearwardly through the central fluid passage turn the rotor.

Other features and advantages will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
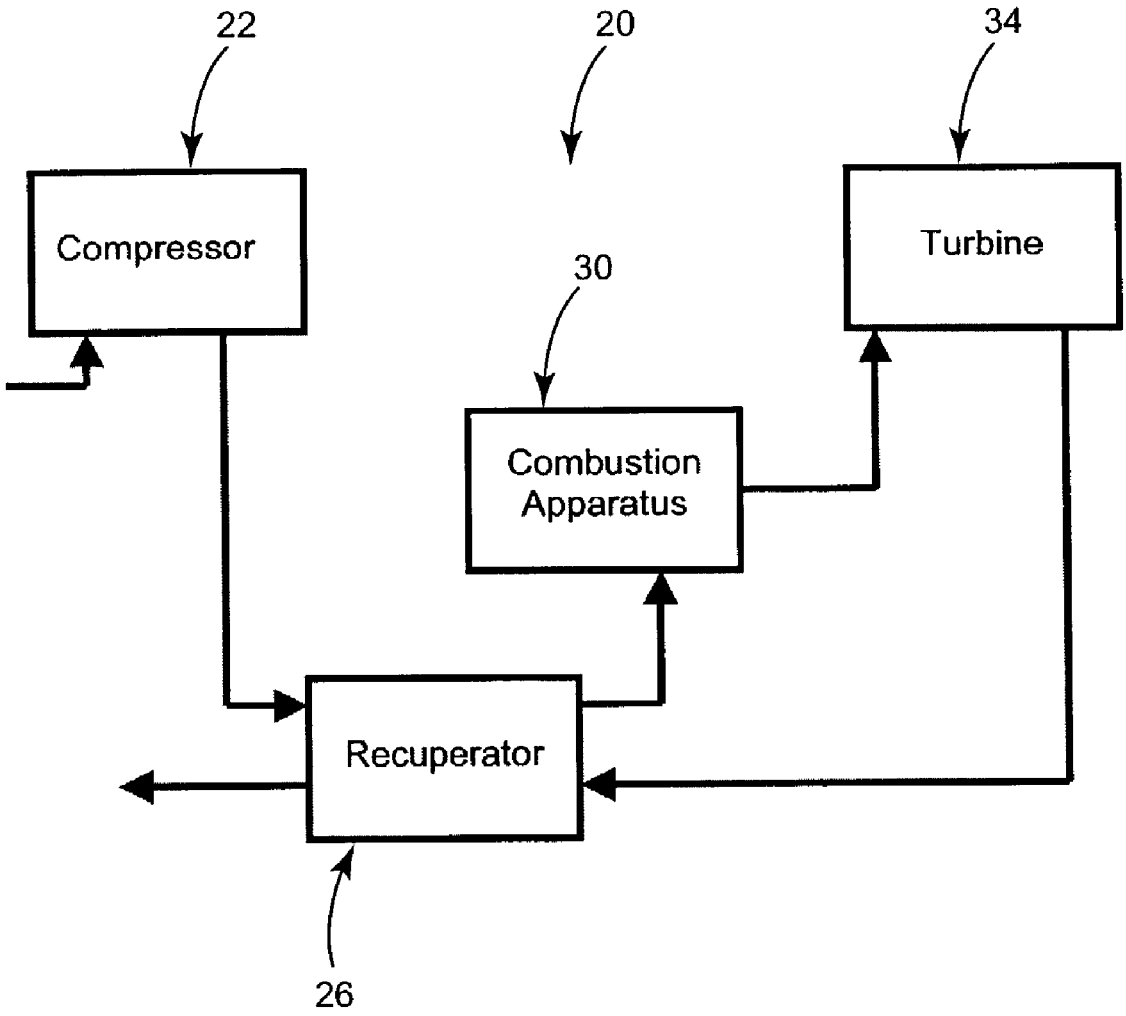
FIG. 1 is a schematic of a system of the present invention, the system comprising a compressor, a recuperator, a combustion apparatus, and a turbine.
Figure 2:
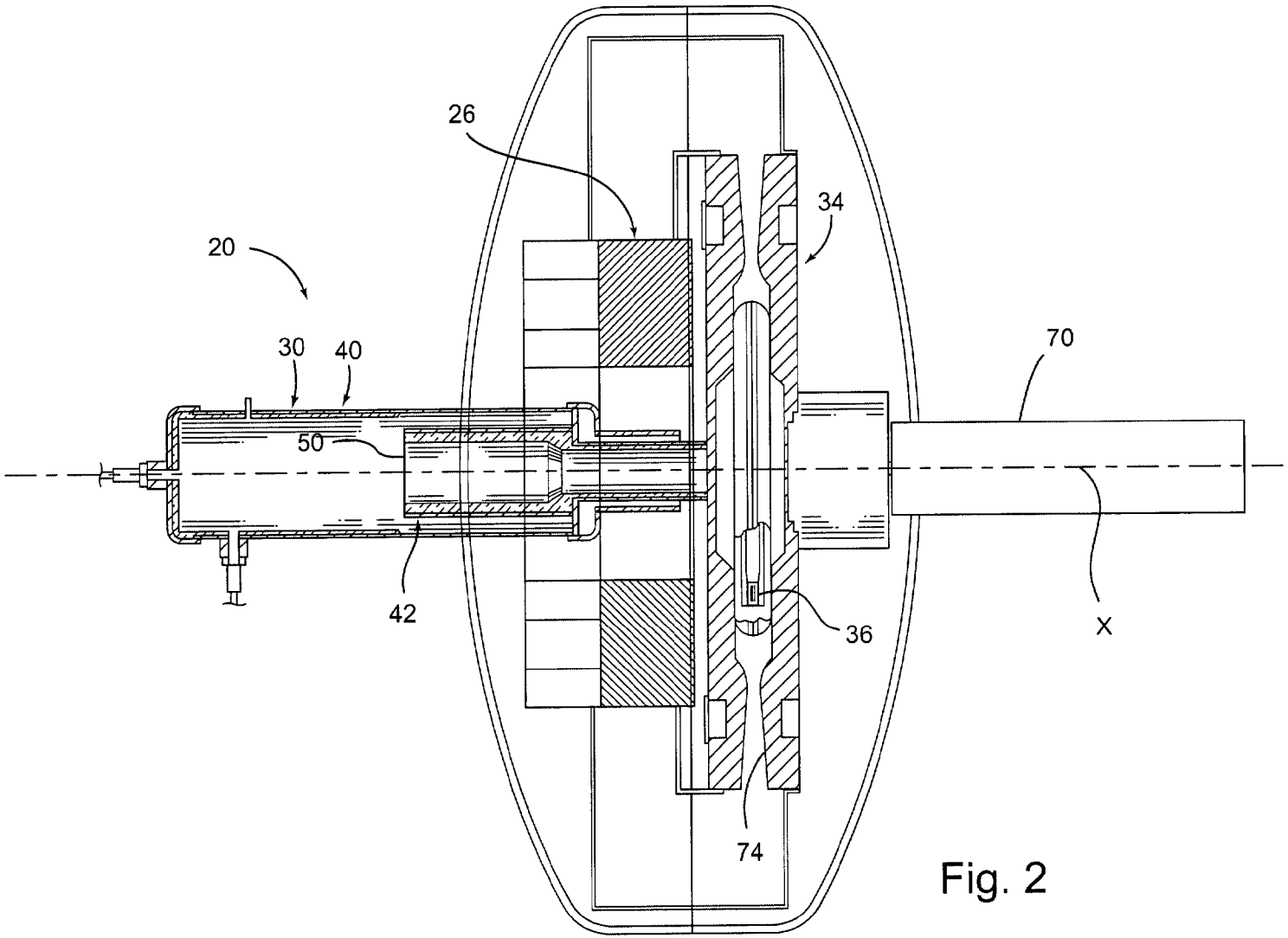
FIG. 2 is a longitudinal sectional view of the system of FIG. 2.

Referring now to the drawings, and more particularly to FIGS. 1 and 2, an embodiment of the present invention is in the form of a system and is indicated in its entirety by the reference numeral 20. The system comprises a compressor 22, a recuperator 26, a combustion apparatus, generally indicated at 30, and a turbine 34. The compressor 22 is preferably a two stage intercooled supercharger and is adapted for delivering pressurized air to the combustion apparatus 30 via the recuperator 26. The combustion apparatus is adapted for forming combustion reaction products to at least in part turn a rotor 36 of the turbine 34.

Figure 3:
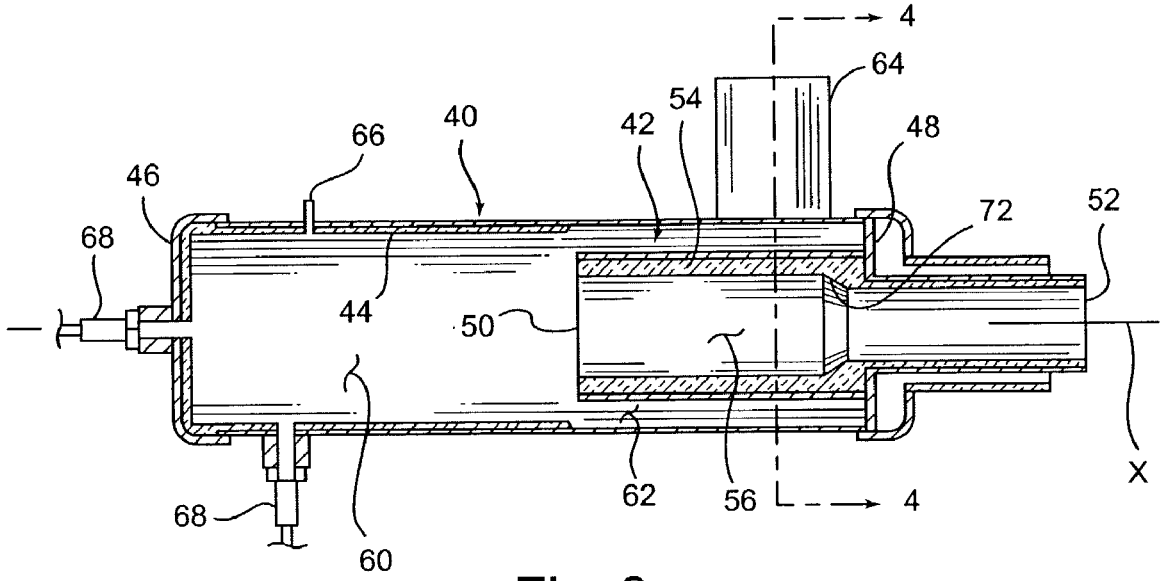
FIG. 3 is a longitudinal section view of the combustion apparatus of the system of FIGS. 1 and 2.
Figure 4:
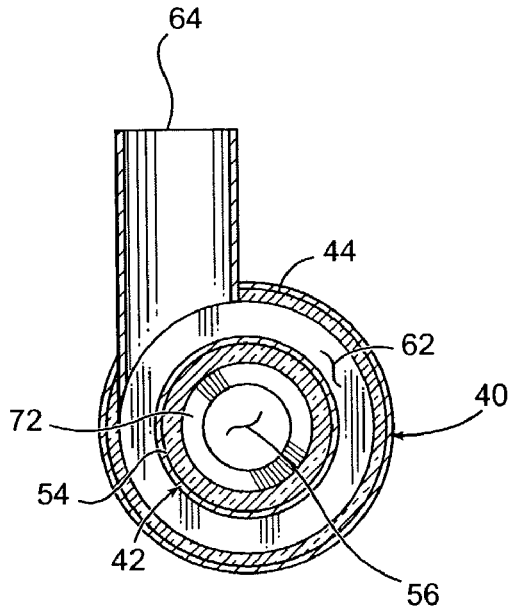
FIG. 4 is a sectional view taken along the plane of line 4—4 of FIG. 3 showing additional details of the combustion apparatus.

Referring to FIGS. 3 and 4, the combustion apparatus 30 comprises an outer vessel, generally indicated at 40, and an inner conduit, generally indicated at 42. The outer vessel 40 preferably has a first longitudinally extending wall 44 extending generally along a central axis X. The first longitudinally extending wall 44 of the outer vessel 40 is preferably cylindrical in shape and is preferably circular in shape when viewed in a cross-section taken in a plane perpendicular to the central axis X. The first longitudinally extending wall 44 may include a thermal insulation layer. The outer vessel 40 further has a forward end 46 (FIG. 3) and a rearward end 48. The rearward end 48 is longitudinally spaced from the forward end (e.g., spaced to the right as viewed in FIG. 3). The inner conduit 42 is at least partially within the outer vessel 40. In the embodiment of FIG. 3, the inner conduit 42 extends rearwardly beyond the outer vessel 40. However, it is to be understood that the inner conduit may be completely within the outer vessel without departing from the scope of this invention. The inner conduit 42 comprises a forward intake port 50, a rearward discharge port 52, and a second longitudinally extending wall 54. The second longitudinally extending wall 54 extends generally along the central axis between the intake and discharge ports 50, 52 and is generally coaxial with the first longitudinally extending wall 44 of the outer vessel 40. The second longitudinally extending wall 54 may include a thermal insulation layer. The outer surface of the second longitudinally extending wall 54 is preferably cylindric in shape and is preferably generally circular in shape as viewed in a cross-section taken in a plane perpendicular to the central axis X. The second longitudinally extending wall 54 has at least a forward longitudinal portion which is spaced radially inwardly of the first longitudinally extending wall. The intake and discharge ports 50, 52 and the inner surface of the second longitudinally extending wall 54 define a central fluid passage 56 through the inner conduit 42. As shown in FIG. 3, the intake port 50 is longitudinally between the forward and rearward ends 46, 48 of the outer vessel and is longitudinally spaced from both of the forward and rearward ends of the outer vessel.

The outer vessel 40 further comprises a forward combustion region 60 and a rearward fluid passage 62. The forward combustion region 60 is at least partially circumscribed by the first longitudinally extending wall 44 and is longitudinally forward of the intake port 50 of the inner conduit 42. The rearward fluid passage 62 is longitudinally rearward of the intake port 50 of the inner conduit 42. The rearward air passage 62 is defined between the first and second longitudinally extending walls 44, 54 and is generally annular in shape. The first longitudinally extending wall 44 preferably has a generally cylindrical-shaped inner surface which is preferably circular in cross-section. The inner surface of the first longitudinally extending wall 44 at least in part defines the combustion region 60. Preferably, the intake port 50 of the inner conduit 42 is longitudinally spaced from the forward end of the outer vessel 40 a distance which is greater than the diameter of the inner surface of the first longitudinally extending wall 44.

The combustion apparatus 30 further comprises a tangential feed air inlet 64, a fuel inlet 66, and one or more igniters 68. The tangential feed air inlet 64 is through the outer vessel 40 for introducing feed air into the rearward fluid passage 62. The feed air inlet 64 is longitudinally spaced between the intake port 50 of the inner conduit 42 and the rearward end of the outer vessel 40. The feed air inlet 64 is adapted and configured such that at least some of the feed air introduced through the feed air inlet and into the rearward fluid passage 62 swirls around the second longitudinally extending wall 54 in a circular path (e.g., in a counterclockwise direction as viewed in FIG. 4). The position of the feed air inlet 64 and the shapes of the rearward fluid passage 62 and the forward combustion region 60 cause the feed air introduced through the feed air inlet to have a tornado-like effect in the rearward fluid passage and the forward combustion region. The fuel inlet 66 is shaped and adapted for introducing fuel (not shown) into the combustion region 60. The igniters 68, which may be spark plugs, torch-type igniters or any other suitable mechanism, are adapted to ignite the fuel in the combustion region 60. The combustion apparatus 30 is adapted to cause the fuel and the feed air to mix in the combustion region 60. The combustion apparatus 30 is also adapted to cause a combustion reaction of the mixed fuel and feed air in the combustion region 60 in a manner to form combustion reaction products and to cause the combustion reaction products to pass rearwardly through the central fluid passage 56 of the inner conduit 42. The combustion apparatus 30 is further adapted such that at least 70%, and more preferably at least 80%, and more preferably at least 90%, and more preferably 100% of the fuel entering the combustion region 60 is combusted in the combustion region.

Referring again to FIGS. 1 and 2, the turbine 34 is preferably a radial out-flow turbine having a rotor and a stator. More preferably, the turbine 34 is a radial out-flow turbine of the type described in co-pending U.S. patent application Ser. No. 09/933,525, filed Aug. 20, 2001, entitled Rotary Heat Engine, which is incorporated herein by reference in its entirety. The turbine 34 is preferably coupled to and powers a generator 70 in a manner to generate electrical power.

In operation, feed air is introduced through the feed air inlet 64 and into the rearward fluid passage 62 in a generally tangential direction relative to the rearward fluid passage in a manner such that at least some of the feed air swirls around the second longitudinally extending wall. The fuel is introduced through the fuel inlet 66 and into the combustion region 60. The fuel may be any type of fuel which burns in the presence of oxygen, such as natural gas, propane, #2 diesel, #6 heavy diesel, hydrogen, bio-diesel, vegetable oil, pulverized coal, liquefied coal slurry, etc.). The shape and operation of the combustion apparatus 30 facilitate mixing of the fuel and the feed air in the combustion region 60. A combustion reaction of at least some of the mixed fuel and feed air occurs in the combustion region 60. A combustion reaction of some of the mixed fuel and feed air may occur in the rearward fluid passage 62. Preferably, at least 70% (and more preferably at least 80%, and more preferably at least 90%, and more preferably 100%) of the fuel entering the combustion region 60 is combusted in either the combustion region or the rearward fluid passage 62 to form combustion reaction products. The combustion reaction products are then discharged longitudinally rearward through the central fluid passage 56 of the inner conduit 42 to turn the rotor 36 of the turbine 34 to thereby drive the generator 70.

Because of the shape and configuration of the combustion apparatus 30, an initial combustion reaction of some of the swirling fuel and feed air occurs in the combustion region 60 to form combustion reaction products. To the extent some of the swirling fuel at least temporarily remains unburned, the swirling is sufficient to cause the unburned fuel to move radially away from the longitudinal axis X and to cause the combustion reaction products to move radially toward the longitudinal axis Before being introduced into the rearward fluid passage 62, the feed air is pressurized by the compressor 22 and pre-heated in the recuperator 26. The feed air is preferably introduced through the air inlet 64 at a pressure of at least 30 $lbs/in^2$ absolute (psia) and more preferably at a pressure of at least 50 psia, and even more preferably at a pressure of at least 60 psia. Preferably, the feed air has a temperature of at least 800° F. (426° C.) as it is introduced through the feed air inlet 64. As it is introduced through the air inlet 64, the feed air more preferably has a temperature at least as great as the ignition temperature (i.e., the lowest temperature of a substance at which sustained combustion can be initiated) of the fuel. As an example, if methane is used as the fuel and if the methane has an ignition temperature of approximately 1100° F. (600° C.), then the feed air preferably has a temperature of at least 1100° F. (600° C.) as it is introduced through the air inlet 64. If the feed air is introduced at a temperature exceeding the fuel's ignition temperature, then emissions are reduced. Preferably the feed air is introduced through the feed air inlet 64 and into the rearward fluid passage 62 at a steady air flow rate and the fuel is introduced into the combustion region 60 at a steady fuel flow rate. Preferably the feed air rate is at least twice as great as the air flow rate needed for stoichiometric combustion of the fuel at the fuel flow rate. Also preferably, the feed air is introduced through the feed air inlet 64 at a velocity of at least 300 feet/second. As used herein the term "air" is sufficiently broad to encompass pure oxygen, any mixture comprising the combination of oxygen and nitrogen, and any mixture comprising oxygen.

Because of the shape of the central fluid passage 56, the combustion reaction products (along with any excess air) swirl in the same circumferential direction (e.g., counterclockwise as viewed in FIG. 4) as the swirling fuel and feed air in the combustion region 60. Preferably, the forward intake port 50 and the upstream portion central fluid passage 56 are sufficiently large such that the discharged combustion reaction products swirl in the central fluid passage. More preferably, the diameter of the intake port 50 and the upstream (i.e., forward) portion of the central fluid passage is at least half the diameter of the inner surface of the first longitudinally extending wall 44. Preferably, the central fluid passage 56 of the inner conduit has a necked-down region 72. The necked-down region 72 increases the swirl velocity downstream of the necked-down region and also properly sizes the downstream portion of the passage for mating with the intake of the rotor 36. Also preferably, the rotor 36 is configured and adapted to rotate in the same direction as the swirling combustion reaction products in the central fluid passage 56 to minimize energy losses.

In the embodiment of FIGS. 3 and 4, the first longitudinally extending wall 44 has an outer diameter of 4.0 inches and a length of 11.75 inches. In the embodiment, the inner conduit 42 has an outer diameter of 2.5 inches and its intake port 50 is longitudinally spaced approximately 6.5 inches rearward of the forward end of the first longitudinally extending wall 44. However, it is to be understood that other dimensions and other ratios may be employed without departing from this invention. preferably second longitudinally extending wall Referring to FIGS. 1 and 2, the outflow (i.e., the combustion reaction products, any excess air, etc.) exit from the rotor 36 and pass through a diffuser 74 of the turbine 34 which decreases the speed of the outflow. After exiting the diffuser 74, the outflow flows through the recuperator 26 to pre-heat the feed air before the feed air is introduced into the combustion apparatus 30.

Pre-heating the air before combustion reduces NOx and other emissions. As discussed above, pre-heating is accomplished with the recuperator 26 combined with the shape and arrangement of the combustion apparatus 30. Rapid mixing of the fuel and air also reduces NOx emissions. Rapid mixing occurs because of the high swirl velocity of the air and by finely atomizing the fuel (which promotes complete combustion). The centrifugal separation and reburning of particulate matter caused by the combustion apparatus 30 also reduces particulate matter emissions. NOx reduction is also accomplished with low temperature combustion. The configuration of the combustion apparatus 30 accommodates a near stoichiometric combustion region followed by a rapid mixing with cooler air to minimize NOx formation. To further reduce NOx formation, water may be added in the form of steam or liquid. Water may be injected with the fuel or mixed with the fuel and preheated, breaking down the fuel in special cases before it is injected into the combustion apparatus 30. Also, oxygenation of fuel promotes more complete combustion and lowers NOx formation. Electrostatic charging of fuel, especially long carbon chain fuels such as bio-diesel ensures complete combustion and lowers NOx. Ozone generation upstream of the combustion air markedly reduces NOx formation. In landfill gas situations, enzymatic fogging may be used to lock-up sulfur and other undesirable compounds to precipitate them from the gas stream before combustion. In landfill gas clean-up, oxygenation, coagulation and magnetic separation may also be used to clean the gas sufficiently to ensure system longevity and to reduce emissions.

Figure 5:
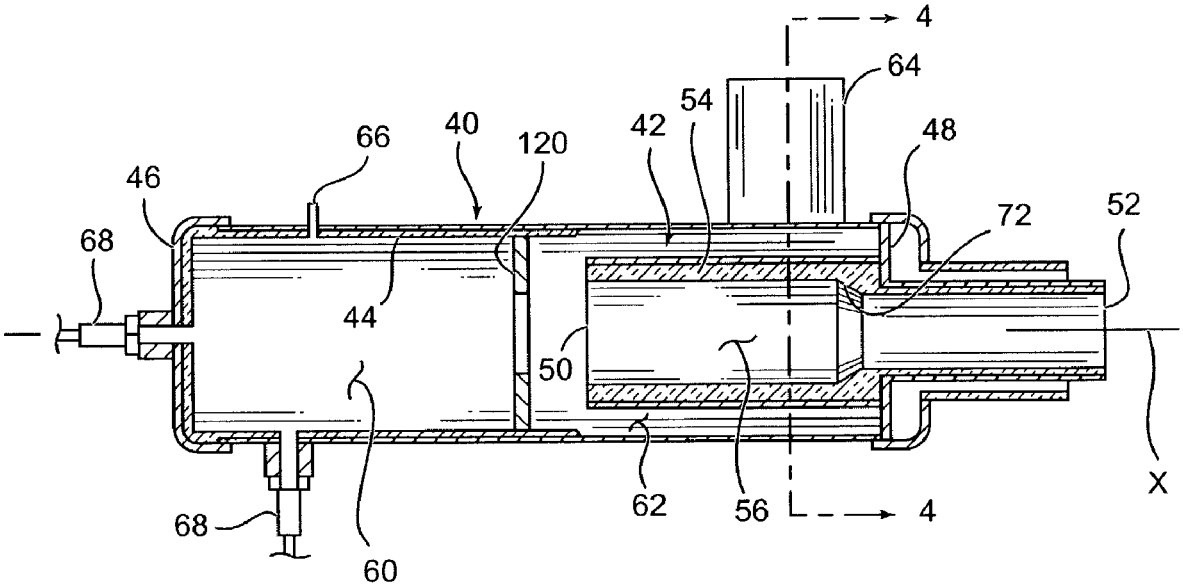
FIG. 5 is a longitudinal section view of another embodiment of a combustion apparatus, similar to the combustion apparatus of FIG. 3, but including a flow divider.

FIG. 5 shows another embodiment of a combustion apparatus, also indicated by the reference numeral 30. The combustion apparatus of FIG. 5 is similar to the combustion apparatus of FIG. 3, except the combustion apparatus of FIG. 5 includes a flow divider 120 forward of and spaced from the forward intake port 50 of the inner conduit 42. Because the only difference between the embodiment of FIG. 5 and the embodiment of FIG. 3 is the flow divider 120, the parts and reference numbers for FIG. 3 are equally applicable to that of FIG. 5. Thus, the above-descriptions concerning the system 20 of FIGS. 1–4 is equally applicable to FIG. 5. Preferably, the flow divider is annular in shape and includes a central opening. The flow divider 120 deflects some of the feed air such that some of the feed air entering the rearward fluid passage 62 from the feed air inlet 64 passes directly into the inner conduit 42 without entering the portion of the combustion region 60 which is forward of the flow divider. The axial position of the flow divider 120 and the size the flow divider's central opening may be selected to regulate the percentage of feed air flowing into the portion of the combustion region 60 which is forward of the flow divider.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method comprising:

providing a combustion apparatus comprising an outer vessel and an inner conduit, the outer vessel having a first longitudinally extending wall extending generally along a central axis, the outer vessel further having a forward end and a rearward end, the rearward end being longitudinally spaced from the forward end, the inner conduit being at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel, the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape;

introducing feed air into the rearward fluid passage in a generally tangential direction relative to the rearward fluid passage in a manner such that at least some of the feed air swirls around the second longitudinally extending wall;

introducing a fuel into the combustion region;

facilitating mixing of the fuel and the feed air in the combustion region;

causing a combustion reaction of the mixed fuel and feed air in the combustion region in a manner such that at least 70% of the fuel entering the combustion region is combusted in either the combustion region or the rearward fluid passage to form combustion reaction products;

discharging the combustion reaction products longitudinally rearward through the central fluid passage of the inner conduit.

2. A method as set forth in claim 1 wherein the first longitudinally extending wall has a generally circular shape when viewed in a cross-section taken in a plane perpendicular to the central axis, and the second longitudinally extending wall has a generally circular shape when viewed in a cross-section taken in a plane perpendicular to the central axis.

3. A method as set forth in claim 1 wherein the feed air has a temperature of at least 800° F. as it is introduced into the rearward fluid passage.

4. A method as set forth in claim 1 wherein the feed air has a pressure of at least 30 psia as it is introduced into the rearward fluid passage.

5. A method as set forth in claim 1 wherein the feed air has a pressure of at least 60 psia as it is introduced into the rearward fluid passage.

6. A method as set forth in claim 1 wherein:

the combustion apparatus further includes a feed air inlet through the outer vessel for introducing the feed air into the rearward fluid passage; and the step of introducing the feed air into the rearward fluid passage further comprises feeding the feed air through the feed air inlet and into the rearward fluid passage, the feed air having a temperature of at least 800° F. as it is fed through the feed air inlet.

7. A method as set forth in claim 1 wherein:

the combustion apparatus further includes a feed air inlet through the outer vessel for introducing the feed air into the rearward fluid passage; and the step of introducing the feed air into the rearward fluid passage further comprises feeding the feed air through the feed air inlet and into the rearward fluid passage, the feed air having a pressure of at least 30 psia as it is fed through the feed air inlet.

8. A method as set forth in claim 7 wherein the feed air has a pressure of at least 60 psia as it is fed through the feed air inlet.

9. A method as set forth in claim 1 wherein at least 80% of the fuel entering the combustion region is combusted in either the combustion region or the rearward fluid passage.

10. A method as set forth in claim 1 wherein at least 90% of the fuel entering the combustion region is combusted in either the combustion region or the rearward fluid passage.

11. A method as set forth in claim 1 wherein 100% of the fuel entering the combustion region is combusted in either the combustion region or the rearward fluid passage.

12. A method as set forth in claim 1 wherein:

the step of introducing the feed air into the rearward fluid passage comprises introducing the feed air into the rearward fluid passage at a feed air rate;

the step of introducing the fuel into the combustion region comprises introducing the fuel into the combustion region at a fuel flow rate;

the feed air rate being at least twice as great as the air flow rate needed for stoichiometric combustion of the fuel at the fuel flow rate.

13. A method as set forth in claim 1 wherein the fuel introduced into the combustion region has an ignition temperature and wherein the feed air has a temperature at least as great as the ignition temperature as the feed air is introduced into the rearward fluid passage.

14. A method comprising:

providing a combustion apparatus comprising an outer vessel and an inner conduit, the outer vessel having a first longitudinally extending wall extending generally along a central axis, the outer vessel further having a forward end and a rearward end, the rearward end being longitudinally spaced from the forward end, the inner conduit being at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel, the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape;

introducing pressurized feed air having a pressure of at least 30 psia into the rearward fluid passage, the pressurized feed air being introduced into the rearward fluid passage in a generally tangential direction relative to the rearward fluid passage in a manner such that at least some of the feed air swirls around the second longitudinally extending wall;

introducing a fuel into the combustion region;

facilitating mixing of the fuel and the feed air in the combustion region;

causing a combustion reaction of the mixed fuel and feed air in the combustion region in a manner such that at least some of the fuel entering the combustion region is combusted in the combustion region to form combustion reaction products;

discharging the combustion reaction products longitudinally rearward through the central fluid passage of the inner conduit.

15. A method as set forth in claim 14 wherein the first longitudinally extending wall has a generally circular shape when viewed in a cross-section taken in a plane perpendicular to the central axis, and the second longitudinally extending wall has a generally circular shape when viewed in a cross-section taken in a plane perpendicular to the central axis.

16. A method as set forth in claim 14 wherein the feed air has a pressure of at least 60 psia as it is introduced into the rearward fluid passage.

17. A method as set forth in claim 14 wherein:

the combustion apparatus further includes a feed air inlet through the outer vessel for introducing the feed air into the rearward fluid passage; and the step of introducing the feed air into the rearward fluid passage further comprises feeding the feed air through the feed air inlet and into the rearward fluid passage.

18. A method as set forth in claim 17 wherein the feed air has a pressure of at least 60 psia as it is fed through the feed air inlet.

19. A method as set forth in claim 14 further comprising:

using the discharged combustion reaction products to at least in part turn a rotor of a turbine.

20. A method as set forth in claim 14 wherein:

the combustion apparatus further includes a feed air inlet through the outer vessel for introducing the feed air into the rearward fluid passage; and the step of introducing the feed air into the rearward fluid passage further comprises feeding the feed air through the feed air inlet and into the rearward fluid passage, the feed air having a temperature of at least 800° F. as the feed air is fed through the feed air inlet.

21. A method as set forth in claim 14 wherein:

the fuel introduced into the combustion region has an ignition temperature;

the combustion apparatus further includes a feed air inlet through the outer vessel for introducing the feed air into the rearward fluid passage; and the step of introducing the feed air into the rearward fluid passage further comprises feeding the feed air through the feed air inlet and into the rearward fluid passage, the feed air having a temperature at least as great as the ignition temperature as the feed air is fed through the feed air inlet.

22. A method comprising:

providing a combustion apparatus;

introducing into the combustion apparatus feed air having a pressure of at least 30 psia;

heating the feed air to a temperature of at least 800° F. before it is introduced into the combustion apparatus introducing a fuel into the combustion apparatus;

using the combustion apparatus to cause at least some of the fuel and at least some of the feed air to swirl within the combustion apparatus and about a longitudinal axis of the combustion apparatus;

causing an initial combustion reaction of some of the swirling fuel and feed air in the combustion apparatus to form combustion reaction products, some of the swirling fuel at least temporarily remaining unburned, the swirling being sufficient to cause the unburned fuel to move radially away from the longitudinal axis and to cause the combustion reaction products to move radially toward the longitudinal axis.

23. A method as set forth in claim 22 further comprising:

discharging the combustion reaction products from the combustion apparatus; and using the discharged combustion reaction products to at least in part turn a rotor of a turbine.

24. A method as set forth in claim 22 wherein:

the step of introducing the feed air into the combustion apparatus comprises introducing the feed air into the combustion apparatus at a feed air flow rate;

the step of introducing the fuel into the combustion apparatus comprises introducing the fuel into the combustion apparatus at a fuel flow rate;

the feed air flow rate being at least twice as great as the air flow rate needed for stoichiometric combustion of the fuel at the fuel flow rate.

25. A combustion apparatus for combusting a fuel, the combustion apparatus comprising:

an outer vessel having a first longitudinally extending wall extending generally along a central axis, the first longitudinally extending wall having a generally circular shape when viewed in a cross-section taken in a plane perpendicular to the central axis, the outer vessel further having a forward end and a rearward end, the rearward end being longitudinally spaced from the forward end;

an inner conduit at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel;

the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape;

a tangential feed air inlet through the outer vessel for introducing feed air into the rearward fluid passage, the feed air inlet being longitudinally spaced between the intake port of the inner conduit and the rearward end of the outer vessel, the feed air inlet being adapted and configured such that at least some of the feed air introduced through the feed air inlet and into the rearward fluid passage swirls around the second longitudinally extending wall;

a fuel inlet for introducing fuel into the combustion region;

the combustion apparatus being adapted to cause the fuel and the feed air to mix in the combustion region, the combustion apparatus further being adapted to cause a combustion reaction of the mixed fuel and feed air in the combustion region in a manner to form combustion reaction products and to cause the combustion reaction products to pass rearwardly through the central fluid passage of the inner conduit, the combustion apparatus further being adapted such that at least 70% of the fuel entering the combustion region is combusted in the combustion region.

26. A combustion apparatus as set forth in claim 25 wherein the second longitudinally extending wall has a generally circular shape when viewed in a cross-section taken in a plane perpendicular to the central axis.

27. A combustion apparatus for combusting a fuel, the combustion apparatus comprising:

an outer vessel having a first longitudinally extending wall extending generally along a central axis, the first longitudinally extending wall having a generally circular shape when viewed in a cross-section taken in a plane perpendicular to the central axis, the outer vessel further having a forward end and a rearward end, the rearward end being longitudinally spaced from the forward end;

an inner conduit at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel;

the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape, the first longitudinally extending wall having a generally cylindrical-shaped inner surface at least in part defining the combustion region, the inner surface of the first longitudinally extending wall being of a first diameter, the intake port of the inner conduit being longitudinally spaced from the forward end of the outer vessel a distance greater than the diameter of the first longitudinally extending wall;

a tangential feed air inlet through the outer vessel for introducing feed air into the rearward fluid passage, the feed air inlet being longitudinally spaced between the intake port of the inner conduit and the rearward end of the outer vessel, the feed air inlet being adapted and configured such that at least some of the feed air introduced through the feed air inlet and into the rearward fluid passage swirls around the second longitudinally extending wall;

a fuel inlet for introducing fuel into the combustion region;

the combustion apparatus being adapted to cause the fuel and the feed air to mix in the combustion region, the combustion apparatus further being adapted to cause a combustion reaction of the mixed fuel and feed air in the combustion region in a manner to form combustion reaction products and to cause the combustion reaction products to pass rearwardly through the central fluid passage of the inner conduit, the combustion apparatus further being adapted such that at least 70% of the fuel entering the combustion region is combusted in the combustion region.

28. A combustion apparatus for combusting a fuel, the combustion apparatus comprising:

an outer vessel having a first longitudinally extending wall extending generally along a central axis, the first longitudinally extending wall having a generally circular shape when viewed in a cross-section taken in a plane perpendicular to the central axis, the outer vessel further having a forward end and a rearward end, the rearward end being longitudinally spaced from the forward end;

an inner conduit at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel;

the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape;

a tangential feed air inlet through the outer vessel for introducing feed air into the rearward fluid passage, the feed air inlet being longitudinally spaced between the intake port of the inner conduit and the rearward end of the outer vessel, the feed air inlet being adapted and configured such that at least some of the feed air introduced through the feed air inlet and into the rearward fluid passage swirls around the second longitudinally extending wall;

a flow divider within the forward combustion region, the flow divider being forward of and spaced from the forward intake port of the inner conduit and being rearward of and spaced from the forward end of the outer vessel;

a fuel inlet for introducing fuel into the combustion region;

the combustion apparatus being adapted to cause the fuel and the feed air to mix in the combustion region, the combustion apparatus further being adapted to cause a combustion reaction of the mixed fuel and feed air in the combustion region in a manner to form combustion reaction products and to cause the combustion reaction products to pass rearwardly through the central fluid passage of the inner conduit, the flow divider being adapted to deflect some of the feed air in a manner such that said some of the feed air flows from the feed air inlet into the inner conduit without flowing into any portion of the combustion region which is forward of the flow divider.

29. A combustion apparatus as set forth in claim 28 wherein the flow divider is generally annular in shape and includes a central opening.

30. A system as set forth in claim 28 further comprising a turbine having a rotor, the turbine being in fluid communication with the central fluid passage of the inner conduit, the turbine and the combustion apparatus being configured and adapted such that the combustion reaction products which pass rearwardly through the central fluid passage turn the rotor.

31. A system comprising:

a compressor adapted to pressurize air to a pressure of at least 30 psia, the compressor having a discharge port for discharging pressurized feed air from the compressor;

a combustion apparatus for combusting a fuel, the combustion apparatus comprising an outer vessel, an inner conduit, a tangential feed air inlet, a fuel inlet, and an igniter, the outer vessel having a first longitudinally extending wall extending generally along a central axis, the first longitudinally extending wall having a generally circular shape when viewed in a cross-section taken in a plane perpendicular to the central axis, the outer vessel further having a forward end and a rearward end, the rearward end being longitudinally spaced from the forward end, the inner conduit being at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel, the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, rearward fluid passage being defined between the first and second longitudinally extending walls and being generally annular in shape, the tangential feed air inlet being in fluid communication with the discharge port of the compressor and being adapted for introducing the pressurized feed air through the outer vessel and into the rearward fluid passage, the feed air inlet being longitudinally spaced between the intake port of the inner conduit and the rearward end of the outer vessel, the feed air inlet being adapted and configured such that at least some of the feed air introduced through the feed air inlet and into the rearward fluid passage swirls around the second longitudinally extending wall, the fuel inlet being adapted to introduce fuel into the combustion region, the igniter being positioned and adapted to ignite the fuel in the combustion region, the combustion apparatus being adapted to cause the fuel and the feed air to mix in the combustion region, the combustion apparatus further being adapted to cause a combustion reaction of the mixed fuel and feed air in the combustion region in a manner to form combustion reaction products and to cause the combustion reaction products to pass rearwardly through the central fluid passage of the inner conduit.

32. A system comprising:

a compressor adapted to pressurize air, the compressor having a discharge port for discharging pressurized feed air from the compressor;

a combustion apparatus for combusting a fuel, the combustion apparatus comprising an outer vessel, an inner conduit, a tangential feed air inlet, and a fuel inlet, the outer vessel having a first longitudinally extending wall extending generally along a central axis, the first longitudinally extending wall having a generally circular shape when viewed in a cross-section taken in a plane perpendicular to the central axis, the outer vessel further having a forward end and a rearward end, the rearward end being longitudinally spaced from the forward end, the inner conduit being at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel, the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape, the tangential feed air inlet being in fluid communication with the discharge port of the compressor and being adapted for introducing the pressurized feed air through the outer vessel and into the rearward fluid passage, the feed air inlet being longitudinally spaced between the intake port of the inner conduit and the rearward end of the outer vessel, the feed air inlet being adapted and configured such that at least some of the feed air introduced through the feed air inlet and into the rearward fluid passage swirls around the second longitudinally extending wall, the fuel inlet being adapted to introduce fuel into the combustion region, the combustion apparatus being adapted to cause the fuel and the feed air to mix in the combustion region, the combustion apparatus further being adapted to cause a combustion reaction of the mixed fuel and feed air in the combustion region in a manner to form combustion reaction products and to cause the combustion reaction products to pass rearwardly through the central fluid passage of the inner conduit; and a radial out-flow turbine having a rotor, the turbine being in fluid communication with the central fluid passage of the inner conduit, the turbine and the combustion apparatus being configured and adapted such that the combustion reaction products which pass rearwardly through the central fluid passage turn the rotor.

33. A method comprising:

providing a combustion apparatus comprising an outer vessel and an inner conduit, the outer vessel having a first longitudinally extending wall extending generally along a central axis, the outer vessel further having a forward end and a rearward end, the rearward end being longitudinally spaced from the forward end, the inner conduit being at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel, the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape, the first longitudinally extending wall having a generally cylindrical-shaped inner surface at least in part defining the combustion region, the inner surface of the first longitudinally extending wall being of a first diameter, the intake port of the inner conduit being longitudinally spaced from the forward end of the outer vessel a distance greater than the diameter of the first longitudinally extending wall;

introducing feed air into the rearward fluid passage in a generally tangential direction relative to the rearward fluid passage in a manner such that at least some of the feed air swirls around the second longitudinally extending wall;

introducing a fuel into the combustion region;

facilitating mixing of the fuel and the feed air in the combustion region;

causing a combustion reaction of the mixed fuel and feed air in the combustion region in a manner forming combustion reaction products;

discharging the combustion reaction products longitudinally rearward through the central fluid passage of the inner conduit.

34. A combustion apparatus for combusting a fuel, the combustion apparatus comprising:

an outer vessel having a first longitudinally extending wall extending generally along a central axis, the first longitudinally extending wall having a generally circular shape when viewed in a cross-section taken in a plane perpendicular to the central axis, the outer vessel further having a forward end and a rearward end, the rearward end being longitudinally spaced from the forward end;

an inner conduit at least partially within the outer vessel and having a forward intake port, a rearward discharge port, and a second longitudinally extending wall extending generally along the central axis between the intake and discharge ports and generally coaxial with the first longitudinally extending wall, the second longitudinally extending wall having at least a forward longitudinal portion which is spaced radially inwardly of the first longitudinally extending wall, the intake and discharge ports and the second longitudinally extending wall defining a central fluid passage through the inner conduit, the intake port being between the forward and rearward ends of the outer vessel and being spaced from both of the forward and rearward ends of the outer vessel;

the outer vessel further comprising a forward combustion region and a rearward fluid passage, the forward combustion region being at least partially circumscribed by the first longitudinally extending wall and being longitudinally forward of the intake port of the inner conduit, the rearward fluid passage being longitudinally rearward of the intake port of the inner conduit, the rearward fluid passage being defined between the first and second longitudinally extending walls and being generally annular in shape, the first longitudinally extending wall having a generally cylindrical-shaped inner surface at least in part defining the combustion region, the inner surface of the first longitudinally extending wall being of a first diameter, the intake port of the inner conduit being longitudinally spaced from the forward end of the outer vessel a distance greater than the diameter of the first longitudinally extending wall;

a tangential feed air inlet through the outer vessel for introducing feed air into the rearward fluid passage, the feed air inlet being longitudinally spaced between the intake port of the inner conduit and the rearward end of the outer vessel, the feed air inlet being adapted and configured such that at least some of the feed air introduced through the feed air inlet and into the rearward fluid passage swirls around the second longitudinally extending wall;

a fuel inlet for introducing fuel into the combustion region;

the combustion apparatus being adapted to cause the fuel and the feed air to mix in the combustion region, the combustion apparatus further being adapted to cause a combustion reaction of the mixed fuel and feed air in the combustion region in a manner to form combustion reaction products and to cause the combustion reaction products to pass rearwardly through the central fluid passage of the inner conduit.

* * * * *